US007626479B2

(12) United States Patent
Kobayashi et al.

(10) Patent No.: US 7,626,479 B2
(45) Date of Patent: Dec. 1, 2009

(54) NOISE FILTER HAVING A PAIR OF CORES AND FOUR CORE HOLDING MEMBERS

(75) Inventors: Katsumi Kobayashi, Tokyo (JP); Masaru Yaguchi, Sakata (JP); Setu Tuchida, Sakata (JP); Toshihiro Kuroshima, Tokyo (JP)

(73) Assignee: TDK Corporation, Tokyo (JP)

( * ) Notice: Subject to any disclaimer, the term of this patent is extended or adjusted under 35 U.S.C. 154(b) by 500 days.

(21) Appl. No.: 11/598,704

(22) Filed: Nov. 14, 2006

(65) Prior Publication Data

US 2007/0120638 A1 May 31, 2007

(30) Foreign Application Priority Data

Nov. 29, 2005 (JP) ..... 2005-343816

(51) Int. Cl.
*H01F 27/29* (2006.01)

(52) U.S. Cl. ..... 336/192; 336/172; 336/175; 336/92

(58) Field of Classification Search ..... 336/174, 336/192
See application file for complete search history.

(56) References Cited

U.S. PATENT DOCUMENTS 5,095,296 A * 3/1992 Parker ..... 336/92
6,268,787 B1 * 7/2001 Onizuka ..... 336/92

FOREIGN PATENT DOCUMENTS

| | | |
|---|---|---|
| JP | U 2-8009 | 1/1990 |
| JP | U 4-137015 | 12/1992 |
| JP | A 11-354971 | 12/1999 |
| JP | A 2003-332136 | 11/2003 |

* cited by examiner

*Primary Examiner*—Elvin G Enad
*Assistant Examiner*—Joselito Baisa
(74) *Attorney, Agent, or Firm*—Oliff & Berridge, PLC

(57) ABSTRACT

A noise filter available for various cable widths and capable of being easily attached to a cable. The noise filter has a first core having both ends to which first and second holding members and are attached, and a second core having both ends to which third and fourth holding members and are attached. First and second contacting portions and are formed on a first facing surface at the first core. Third and fourth contacting portions are formed on a second facing surface at the second core. When the first and second contacting portions are brought into contact with the third and fourth contacting portions an insertion hole is provided between the first and second contacting portions and between the first and second facing surfaces. The first and third holding members are coupled to each other by a retaining portion and retaining projection. The second and fourth holding members and are coupled to each other by a hinge portion.

6 Claims, 6 Drawing Sheets

NOISE FILTER HAVING A PAIR OF CORES AND FOUR CORE HOLDING MEMBERS

BACKGROUND OF THE INVENTION

The present invention relates to a noise filter, and more particularly, to a noise filter adaptable for various cable widths.

Conventionally, in a notebook size personal computer, so-called a flat cable has been used for signal transmission when an image is output from a main PC body to a monitor. In order to remove noise on the flat cable, a noise filter is disposed over the flat cable. For example, laid-open Japanese Utility Model Application Publication No. H2-8009 discloses a noise filter in which a core and a case holding the core are integrally formed to hold the flat cable. However, with such arrangement, a plurality of cases has needed to be prepared in accordance with various flat cable widths.

Laid open Japanese Patent Application Publication No. 2003-332136 discloses a noise filter in which a case is attached to the cores after the flat cable is pinched by the cores. However, the cores need to be fixed to the flat cable, for example, the cores pinching the flat cable need to be held with a hand. This lowers assembleability or workability.

SUMMARY OF THE INVENTION

It is therefore, an object of the present invention to provide a noise filter available for various cable widths with only one kind of case, and capable of being easily attached to a cable.

This and other objects of the present invention will be attained by a noise filter including first and second cores, first through fourth holding members, and first and second coupling portions. The first core has a first facing surface and has one end portion provided with a first contacting portion at a side of the first facing surface and another end portion provided with a second contacting portion at the side of the first facing surface. The second core has a second facing surface confrontable with the first facing surface and has a first end portion provided with a third contacting portion at a side of the second facing surface and contactable with the first contacting portion and a second end portion provided with a fourth contacting portion at a side of the second facing surface and contactable with the second contacting portion. A cable insertion hole is defined between the first facing surface and the second facing surface and between the first contacting portion and the second contacting portion when the first contacting portion and the second contacting portion are in surface contact with the third contacting portion and the fourth contacting portion, respectively. The first holding member is detachably connectable to the one end portion. The second holding member is detachably connectable to the other end portion. The third holding member is detachably connectable to the first end portion. The fourth holding member is detachably connectable to the second end portion. The first coupling portion is provided to couple the first holding member to the third holding member for maintaining a surface contact between the first contacting portion and the third contacting portion. The second coupling portion is provided to couple the second holding member to the fourth holding member for maintaining a surface contact between the second contact portion and the fourth contacting portion.

Preferably, the first core includes a first set of plurality of first cores each providing the one end portion identical to one another and another end portion identical to one another, and each providing a distance between the first contacting portion and the second contacting portion different from one another.

One of the first cores in the first set is selected in accordance with a width of a cable. Further, the second core includes a second set of plurality of second cores each providing the first end portion identical to one another and second end portion identical to one another, and each providing a distance between the third contacting portion and the fourth contacting portion different from one another. One of the second cores in the second set is selected in accordance with the selection of the one of the first cores in the first set.

DETAILED DESCRIPTION OF THE PREFERRED EMBODIMENTS

Figure 1:
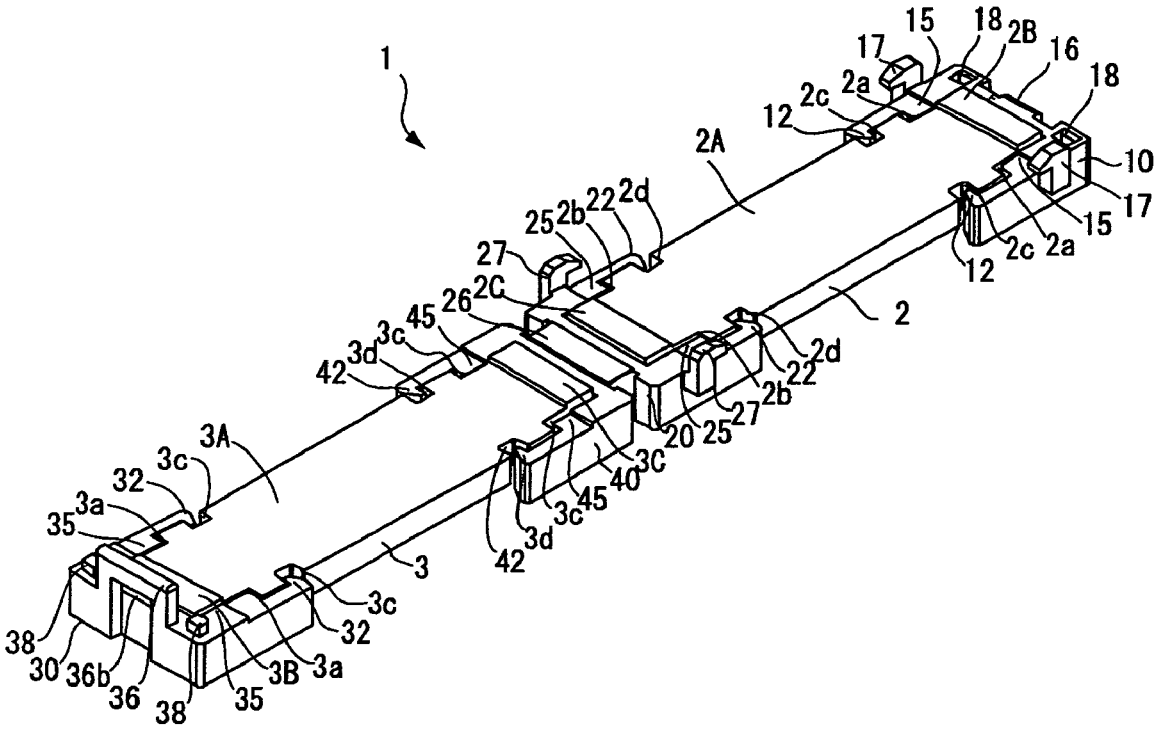
FIG. 1 is a perspective view of a noise filter according to an embodiment of the present invention in an open state.

A noise filter according to an embodiment of the present invention will be described with reference to FIGS. 1 to 6. A noise filter 1 shown in FIG. 1 includes a first core 2, a second core 3, a first holding member 10, a second holding member 20, a third holding member 30, and a fourth holding member 40.

The first core 2 has one end to which the first holding member 10 is attached and another end to which the second holding member 20 is attached. The second core 3 has one end to which the third holding member 30 is attached and another end to which the fourth holding member 40 is attached.

Figure 2:
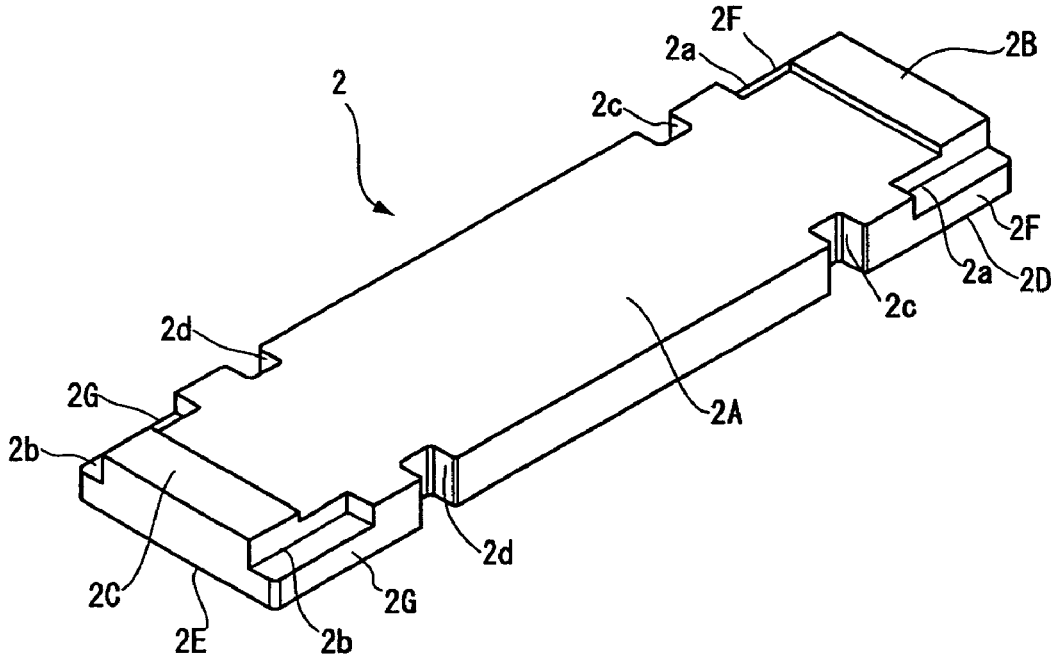
FIG. 2 is a perspective view of a first core of the noise filter according to the embodiment.
Figure 4:
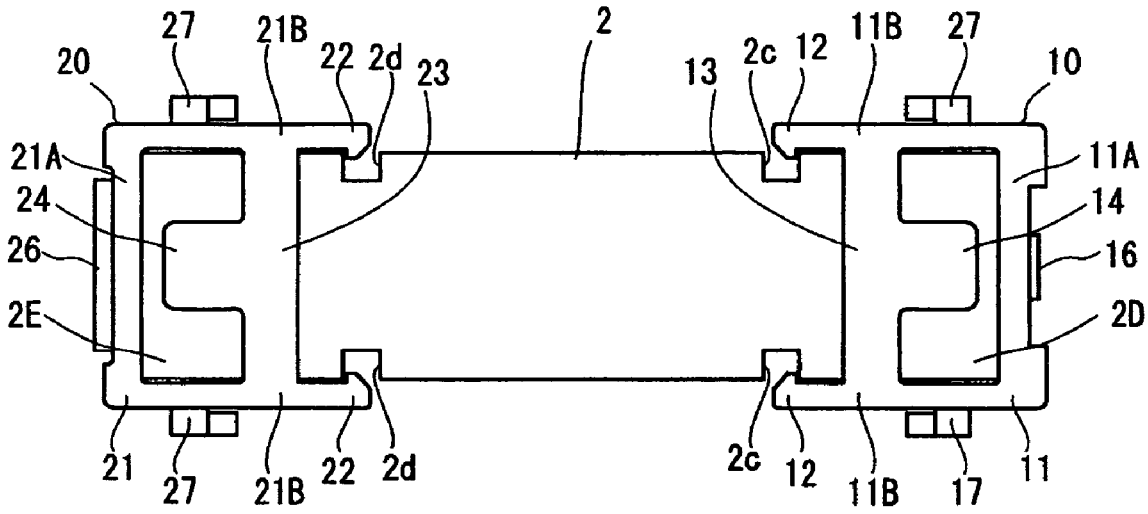
FIG. 4 is a plan view of the noise filter according to the embodiment as viewed from the first core side.

As shown in FIG. 2, the first core 2 is substantially a plate-like ferrite core and has one surface defined as a first facing surface 2A that faces the second core 3. First and second contacting portions 2B and 2C protruding from the first facing surface 2A are formed on the first facing surface 2A at the one end and the other end of the first core 2, respectively. Direction from the one end toward the other end of the first core 2 is defined as a lengthwise direction. The first and second contacting portions 2B and 2C have top planar surfaces flush with each other. Further, as shown in FIGS. 2 and 4, first and second biased surfaces 2D and 2E are defined on the reverse side of the first facing surface 2A at the positions on the reverse sides of the first and second contacting portions 2B and 2C. These biased surfaces 2D and 2E are biased by first and second biasing portions 14 and 24 (to be described later) of the first and second holding members 10 and 20.

Direction from the first and second biased surfaces 2D and 2E toward the first facing surface 2A is defined as a thickness direction, and direction perpendicular to the lengthwise direction and thickness direction is defined as a widthwise direction. The one end and the other end of the first core 2 are formed into the configuration identical to each other.

As shown in FIG. 2, at the positions on the one end side of the first core 2, a pair of first cut grooves 2*a* and 2*a* are formed on both widthwise sides of the first facing surface 2A and extend from the one end to the other end of the first core 2 in the lengthwise direction. The first cut grooves 2*a* and 2*a* serve as a first held area. Similarly, at the positions on the other end side of the first core 2, a pair of second cut grooves 2*b* and 2*b* are formed on both widthwise sides of the first facing surface 2A and extend from the other end to the one end of the first core 2 in the lengthwise direction. The second cut grooves 2*b* and 2*b* serve as a second held area.

A pair of first groove portions 2*c* and 2*c*, which open in the thickness direction, are formed at one lengthwise end side of the first core 2 and near the terminal ends of the first cut grooves 2*a* and 2*a*. The first groove portions 2*c* and 2*c* serve as a first engaged area. Similarly, a pair of second groove portions 2*d* and 2*d*, which open in the thickness direction, are formed at the other lengthwise end side of the first core 2 and near the terminal ends of the second cut grooves 2*b*, 2*b*. The second groove portions 2*d*, 2*d* serve as a second engaged area.

Portions which are located at the one end of the first core 2 and whose thicknesses are reduced due to formation of the first cut grooves 2*a*, 2*a* are defined as a first flange portions 2F, 2F. Similarly, portions which are located at the other end of the first core 2 and whose thicknesses are reduced due to formation of the second cut grooves 2*b*, 2*b* are defined as a second flange portions 2G, 2G.

As shown in FIG. 1, the second core 3 has the same configuration as that of the first core 2. The second core 3 has third and fourth contacting portions 3B and 3C which can respectively contact the first and second contacting portions 2B and 2C at both ends of a second facing surface 3A, third groove portions 3*c*, 3*c* serving as a third engaged area and third cut grooves 3*a*, 3*a* serving as a third held area formed at one longitudinal end side of the second core 3, fourth groove portions 3*d* and 3*d* serving as a fourth engaged area and fourth cut grooves 3*b*, 3*b* serving as a fourth held area formed at the other longitudinal end side of the second core 3, and a pair of third flange portions and a pair of fourth flange portions corresponding to the first and second flange portions 2F and 2G.

Figure 3:
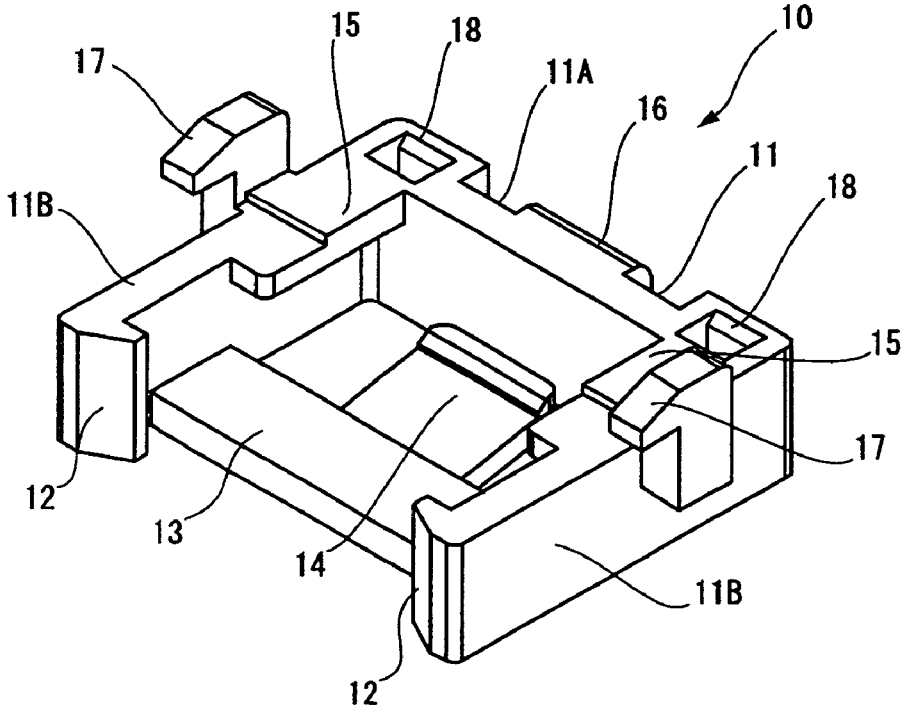
FIG. 3 is a perspective view of a first holding member of the noise filter according to the embodiment.

As shown in FIG. 3, the first holding member 10 to be attached to the one end of the first core 2 is generally constituted by substantially a U-like shaped first frame 11 including a first base portion 11A and a pair of arm portions 11B and 11B extending from both ends of the first base portion 11A. With regard to the first frame 11, extending direction of the first arm portions 11B and 11B is defined as a lengthwise direction, direction from one first arm portion 11B toward the other first arm portion 11B is defined as a widthwise direction, and direction perpendicular to the lengthwise and widthwise directions is defined as a thickness direction.

A pair of first engaging portions 12, 12 are formed at the leading ends of the pair of first arm portions 11B, 11B. The first engaging portions 12, 12 are formed into claw-like shapes whose tip ends extend in the direction so that the tip ends face with each other. The first engaging portions 12, 12 are engageable with the first groove portions 2*c*, 2*c*. A connecting portion 13 is bridging between the pair of first arm portions 11B, 11B. The connecting portion 13 is located near the pair of first engaging portions 12, 12 and is positioned on one end side of the first frame 11 in the thickness direction. A first biasing portion 14 extends from substantially widthwise center portion of the connecting portion 13 toward the first base portion 11A, and oriented toward the other end side of the first frame 11 in the thickness direction. The first biasing portion 14 is adapted for biasing the first biased surface 2D.

A pair of first holding portions 15, 15 engageable with the first cut grooves 2*a*, 2*a*, are formed on the first arm portions 11B, 11B at positions close to the first base portion 11A and on the other end side of the first frame 11 in the thickness direction. A retaining projection 16 engageable with a retaining portion 36 (to be described later) is formed at the first base portion 11A. The retaining projection is provided at a reverse surface opposite to the surface from which the first arm portions 11B, 11B extend, and at an intermediate position between one first arm portion 11B and the other first arm portion 11B.

A pair of first position restraining pieces 17, 17 are provided at outer side surfaces of the first arm portions 11B, 11B in the widthwise direction. The outer side surfaces are perpendicular to the widthwise direction of the first frame 11. The pair of first position restraining pieces 17, 17 have tip ends each provided with a hook-like shape whose thickness is gradually reduced toward its end in the longitudinal direction. Further, concave portions 18, 18 into which convex portions 38, 38 (to be described later) are insertable are formed on the surface of the first base portion 11A at positions close to base ends of the first arm portions 11B, 11B and on the other end side of the first base portion 11A in the thickness direction.

The second holding member 20 to be attached to the other end of the first core 2, as shown in FIG. 4, includes a second base portion 21A and a pair of second arm portions 21B and 21B. Further, second engaging portions 22, 22, second connecting portion 23, and a second biasing portion 24 are provided as in the case of the first holding member 10.

A resilient or elastically deformable hinge portion 26 serving as a second coupling portion is bridged between the fourth and second holding members 40 and 20 for coupling the fourth and second holding members 40 and 20 together. The hinge portion 26 is positioned to a side confronting the second biased surfaces 2E. Further, second holding portions 25, 25 are formed at the second arm portions 21B, 21B at positions close to the second base portion 21A, and second position restraining pieces 27, 27 are formed on the side surfaces of the second arm portions 21B, 21B.

The third holding member 30 has substantially the same configuration as that of the first holding member 10. Therefore, 20 are added to each of reference numbers of the components of the first holding member 10 shown in FIG. 4 for omitting duplicating description. The difference from the first holding member 10 is that the third holding member 30 has, as shown in FIG. 1, convex portions 38, 38 to be inserted into the concave portions 18 and 18 are formed at the positions corresponding to the concave portions 18, 18 of the first holding member 10. Further, a retaining portion 36 to be engaged with the retaining projection 16 is formed at a position corresponding to the retaining projection 16 of the first holding member 10. A retaining hole 36*a* is formed in the retaining portion 36. The retaining projection 16 and retaining portion 36 constitute a first coupling portion.

The fourth holding member 40 has substantially the same configuration as those of the first and second holding members 10 and 20. Therefore, 30 are added to each of reference numbers of the components of the first holding member 10 shown in FIGS. 1 to 4, or 20 are added to each of the reference numbers of the components of the second holding member 20 and descriptions of the fourth holding member 40 are omitted.

Now, attachment of the first to fourth holding members 10 to 40 to the first and second cores 2 and 3 will be described. Taking the first holding member 10 for instance, one end of the first core 2 is inserted between the pair of first arm portions 11B, 11B, as shown in FIG. 4. Specifically, the first holding portions 15, 15 (FIG. 3) of the first holding member 10 are inserted into the first cut grooves 2*a*, 2*a* (FIG. 2) of the first core 2 and, at the same time, the first biased surface 2D of the first core 2 is brought into contact with the first biasing portion 14 of the first holding member 10. Accordingly, the first biased surface 2D is slid on the first biasing portion 14 to allow the pair of flange portions 2F, 2F (FIG. 2) to be inserted into the position between the first holding portions 15, 15 and first biasing portion 14. When the leading end of the one end of the first core 2 reaches the first base portion 11A of the first holding member 10, the first engaging portions 12, 12 formed at the tip ends of the first arm portions 11B, 11B of the first holding member 10 are engaged with the first groove portions 2*c*, 2*c* of the first core 2.

In this state, movement of the one end of the first core 2 in the thickness direction of the first holding member 10 is restricted by the first biasing portion 14 and first holding portions 15, 15. Further, movement of the one end of the first core 2 in the lengthwise and widthwise directions of the first holding member 10 is restricted by the first arm portions 11B, 11B and first engaging portions 12, 12. Thus, the first holding member 10 attached to the one end of the first core 2 is stably fixed to the first core 2. Similarly, the second holding member 20 is attached to the other end of the first core 2 as shown in FIG. 2, and the third and fourth holding members 30 and 40 are attached to the one end and the other end of the second core 3, respectively.

For assembling the noise filter 1 having the above configuration to a flat cable 9 (FIG. 5), the flat cable 9 is disposed on the position between the first and second contacting portions 2B and 2C of the first facing surface 2A, and between the first position restraining pieces 17, 17 and second position restraining pieces 27, 27. Thus, the flat cable 9 is not disposed on the first contacting portion 2B or second contacting portion 2C. Consequently, the flat cable 9 can be disposed accurately between the first and second contacting portions 2B and 2C.

Further, the flat cable 9 is engaged with the first position restraining pieces 17, 17 and second position restraining pieces 27, 27. This prevents the noise filter 1 from being separated or dropped from the flat cable 9 even if a worker releases his hands from the noise filter 1 during attachment of the noise filter 1. Further, even if the cable 9 is not completely nipped between the first and second cores 2 and 3, the position of the noise filter 1 can be temporarily fixed by the temporary engagement of the position restraining pieces 17,17, 27, 27 with the flat cable 9.

Figure 5:
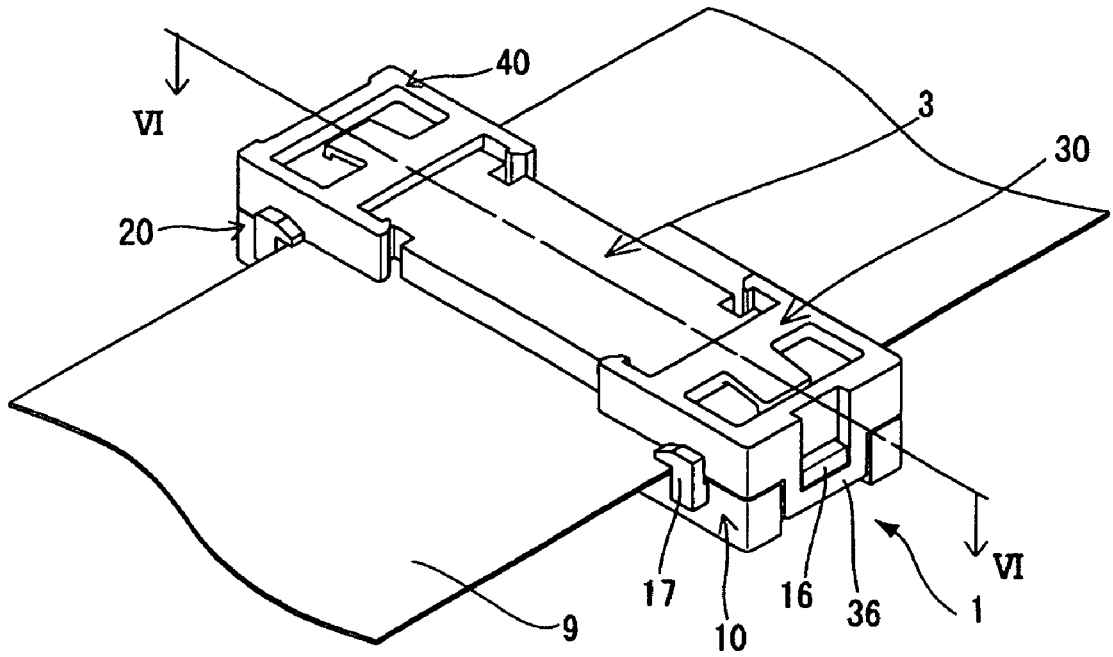
FIG. 5 is a perspective view showing a state in which the noise filter according to the embodiment has been attached to a flat cable.
Figure 6:
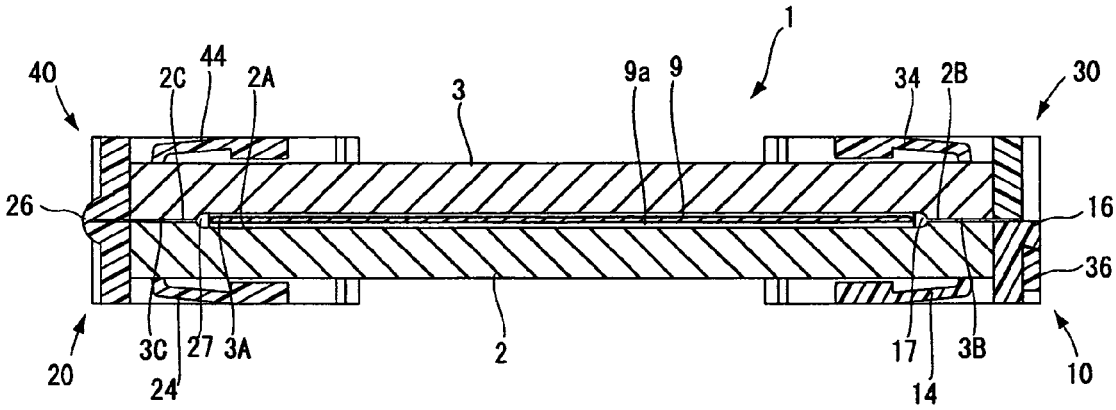
FIG. 6 is a cross-sectional view taken along the line VI-VI of FIG. 5.

After the positioning the flat cable 9 between the first and second contacting portions 2B and 2C, the second core 3 can be pivotally moved about the hinge portion 26 toward the first core 2, thereby pinching the flat cable 9 between the firs and second cores 2 and 3, as shown in FIG. 5. At this time, as shown in FIG. 6, the first and third contacting surfaces 2B and 3B are brought into surface contact with each other and, at the same time, second and fourth contacting surfaces 2C and 3C are brought into surface contact with each other. As a result, a closed magnetic path is formed between the first and second cores 2 and 3, and an insertion path 9*a* through which the flat cable 9 extends is formed in the area between the first and second contacting portions 2B and 2C and between the first and second facing surfaces 2A and 3A. Thus, the flat cable 9 is positioned in the closed magnetic path, so that noise on the flat cable 9 can satisfactorily be removed by means of the noise filter 1.

Further, in a state where the noise filter 1 has been folded, the convex portions 38, 38 formed in the third holding member 30 are inserted respectively into the concave portions 18, 18 formed in the first holding member 10. At the same time, the retaining portion 36 formed in the third holding member 30 is engaged with the retaining projection 16 formed in the first holding member 10. Thus, since the first and third holding members 10 and 30 are coupled to each other in a fully integrated manner and the second and fourth holding members 20 and 40 are coupled to each other by the hinge portion 26, the first core 2 and the second core 3 are coupled to each other in an integrated manner. Therefore, simple coupling between the first and third holding members 10 and 30 allows easy attachment of the noise filter 1 to the flat cable 9.

In the above-described embodiment, the first and second cores 2 and 3 only meet a given flat cable width. However, a noise filter available for various flat cable width can be provided without changing the configuration of the first to fourth holding members 10 to 40. This can be achieved by preparing a plurality of cores each having a different distance between the first and second groove portions 2*c* and 2*d* and having the same configuration as those of the both end portions of the first and second cores 2 and 3.

While the invention has been described in detail and with reference to the specific embodiment thereof, it would be apparent to those skilled in the art that various changes and modifications may be made therein without departing the scope of the invention. For example, in the above described embodiment, facing surfaces 2A and 3A are flat for the assembly to the flat cable. However, the facing surfaces between the first and second contacting portions 2B and 2C can be formed into an arcuate shape, so that the noise filter can be available for a cylindrically-shaped cable. That is, the noise filter according to the present invention can also be applied to any cables other than the flat cable.

Figure 7:
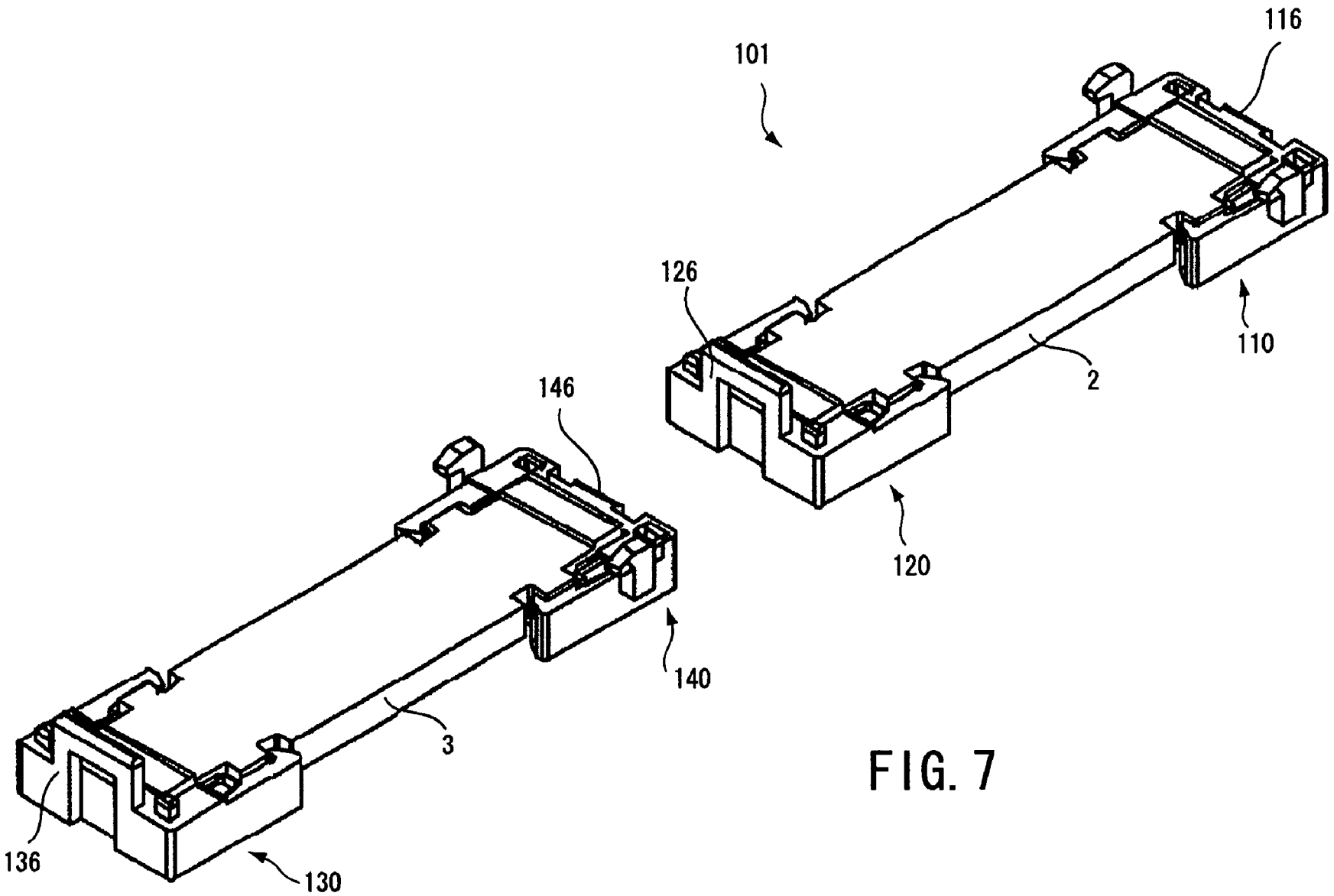
FIG. 7 is a perspective view of a noise filter according to a modification to the first embodiment.
Figure 8:
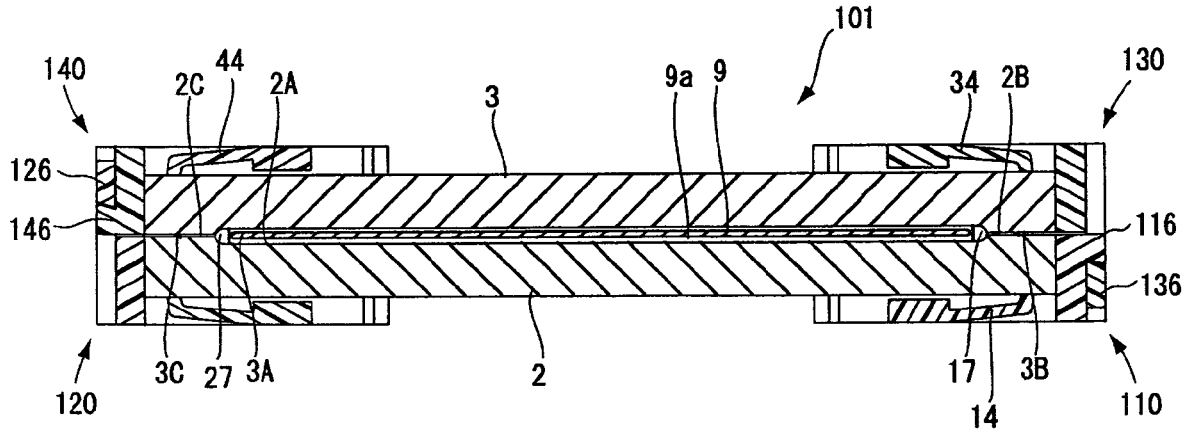
FIG. 8 is a cross-sectional view showing a coupling state of the noise filter according to the modification.

Further, the retaining projection 16 and retaining portion 36 are provided as the first coupling portion, and the hinge portion 26 is provided as the second coupling portion in the above embodiment. However, the configuration of the first and second coupling portions is not limited to the above described embodiment. For example, the retaining projection and retaining portion can be provided as first and second coupling portions. In the latter case, as shown in FIGS. 7 and 8, first and fourth holding members 110 and 140 can be configured into identical shape with each other so as to have retaining projections 116, 146, and further, the second and third holding members 120 and 130 can also be configured into identical shape with each other so as to have the retaining portions 126, 136, thereby reducing the number of components. Alternatively, first and second holding members can be configured into identical shape with each other, and further, the third and fourth holding members can also be configured into identical shape with each other.

Further, cable position restraining pieces 17, 17, and 27, 27 are provided at the first holding member 10 and the second holding member 20, respectively. However, the restraining pieces can be provided at third and fourth holding members 30 and 40, or at the first and third holding members 10 and 30, or at second and fourth holding members 20 and 40 as long as these restraining pieces can prevent lateral shifting of the cable.

What is claimed is:

1. A noise filter comprising:

a first core having a first facing surface and having one end portion provided with a first contacting portion at a side of the first facing surface and another end portion provided with a second contacting portion at the side of the first facing surface;

a second core having a second facing surface confrontable with the first facing surface and having a first end portion provided with a third contacting portion at a side of the second facing surface and contactable with the first contacting portion and a second end portion provided with a fourth contacting portion at a side of the second facing surface and contactable with the second contacting portion, a cable insertion hole being defined between the first facing surface and the second facing surface and between the first contacting portion and the second contacting portion when the first contacting portion and the second contacting portion are in surface contact with the third contacting portion and the fourth contacting portion, respectively;

a first holding member detachably connectable to the one end portion;

a second holding member detachably connectable to the another end portion;

a third holding member detachably connectable to the first end portion;

a fourth holding member detachably connectable to the second end portion;

a first coupling portion provided to couple the first holding member to the third holding member for maintaining a surface contact between the first contacting portion and the third contacting portion; and a second coupling portion provided to couple the second holding member to the fourth holding member for maintaining a surface contact between the second contact portion and the fourth contacting portion, wherein the first holding member, the second holding member, the third holding member and the fourth holding member are independent holding members.

2. The noise filter as claimed in claim 1, wherein the first coupling portion comprises a retained portion provided at one of the first holding member and the third holding member, and a retaining portion engageable with the retained portion and provided at remaining one of the first holding member and the third holding member; and wherein the second coupling portion comprises a hinge resiliently bridging between the second holding portion and the fourth holding portion.

3. The noise filter as claimed in claim 1, wherein the first coupling portion comprises a retained portion provided at one of the first holding member and the third holding member, and a retaining portion engageable with the retained portion and provided at remaining one of the first holding member and the third holding member, and wherein the second coupling portion comprises a second retained portion provided at one of the second holding member and the fourth holding member, and a second retaining portion engageable with the second retained portion and provided at remaining one of the second holding member and the fourth holding member.

4. The noise filter as claimed in claim 1, wherein the one end portion of the first core comprises a first engaged area, a first held area arranged at the first facing surface, and a first biased surface opposite to the first facing surface; and wherein the another end portion of the first core comprises a second engaged area, a second held area arranged at the first facing surface, and a second biased surface opposite to the first facing surface; and wherein the first end portion of the second core comprises a third engaged area, a third held area arranged at the second facing surface, and a third biased surface opposite to the second facing surface; and wherein the second end portion of the second core comprises a fourth engaged area, a fourth held area arranged at the second facing surface, and a fourth biased surface opposite to the second facing surface; and wherein the first holding member comprises a first biasing portion in contact with the first biased surface for biasing the first core in a first direction from the first biased surface to the first facing surface; a first holding portion in contact with the first held area for restricting a movement of the first core relative to the first holding member in the first direction; and a first engaging portion engageable with the first engaged area for restricting a movement of the first core relative to the first holding member in a direction from the one end portion toward the another end portion, when the first holding member is attached to the one end portion of the first core; and wherein the second holding member comprises a second biasing portion in contact with the second biased surface for biasing the first core in a second direction from the second biased surface to the first facing surface; a second holding portion in contact with the second held area for restricting a movement of the first core relative to the second holding member in the second direction; and a second engaging portion engageable with the second engaged area for restricting a movement of the second core relative to the first holding member in a direction from the another end portion toward the one end portion, when the second holding member is attached to the another end portion of the first core; and wherein the third holding member comprises a third biasing portion in contact with the third biased surface for biasing the second core in a third direction from the third biased surface to the second facing surface; a third holding portion in contact with the third held area for restricting a movement of the second core relative to the third holding member in the third direction; and a third engaging portion engageable with the third engaged area for restricting a movement of the second core relative to the third holding member in a direction from the first end portion toward the second end portion, when the third holding member is attached to the first end portion of the second core; and wherein the fourth holding member comprises a fourth biasing portion in contact with the fourth biased surface for biasing the second core in a fourth direction from the fourth biased surface to the second facing surface; a fourth holding portion in contact with the fourth held area for restricting a movement of the second core relative to the fourth holding member in the fourth direction; and a fourth engaging portion engageable with the fourth engaged area for restricting a movement of the second core relative to the fourth holding member in a direction from the second end portion toward the first end portion, when the fourth holding member is attached to the second end portion of the second core.

5. The noise filter as claimed in claim 1, further comprising cable position restraining pieces provided at the first holding member and the second holding member and at positions between the first contacting portion and the second contacting portion.

6. The noise filter as claimed in claim 1, wherein the first core comprises a first set of plurality of first cores each providing the one end portion identical to one another and another end portion identical to one another, and each providing a distance between the first contacting portion and the second contacting portion different from one another, one of the first cores in the first set being selected in accordance with a width of a cable; and wherein the second core comprises a second set of plurality of second cores each providing the first end portion identical to one another and second end portion identical to one another, and each providing a distance between the third contacting portion and the fourth contacting portion different from one another, one of the second cores in the second set being selected in accordance with the selection of the one of the first cores in the first set.

* * * * *